United States Patent [19]

Sundermeier

[11] 4,312,098

[45] Jan. 26, 1982

[54] HINGE FOR THE DOORS OF CABINETS OR THE LIKE

[75] Inventor: Günter Sundermeier, Bündle, Fed. Rep. of Germany

[73] Assignee: Paul Hettich & Co., Kirchlengern, Fed. Rep. of Germany

[21] Appl. No.: 81,155

[22] Filed: Oct. 2, 1979

[30] Foreign Application Priority Data

Sep. 1, 1979 [DE] Fed. Rep. of Germany ... 7924808[U]

[51] Int. Cl.³ ..... E05D 7/04

[52] U.S. Cl. ..... 16/240; 16/387

[58] Field of Search ..... 16/163, 164, 130, 131, 16/132, 133, 129

[56] References Cited

U.S. PATENT DOCUMENTS

| | | | |
|---|---|---|---|
| 4,007,513 | 2/1977 | Zernig | 16/129 |
| 4,142,271 | 3/1979 | Busse | 16/129 |
| 4,207,652 | 6/1980 | Lautenschläger | 16/130 |

FOREIGN PATENT DOCUMENTS

| | | | |
|---|---|---|---|
| 1809616 | 7/1969 | Fed. Rep. of Germany | 16/130 |

*Primary Examiner*—Andrew V. Kundrat

*Attorney, Agent, or Firm*—Peter K. Kontler

[57] ABSTRACT

The open front of the housing of a cabinet is flanked by a vertical strip having a front surface and a second surface adjacent to the open front and making with the front surface an angle of 90 degrees. The strip carries a door panel one vertical marginal portion of which is coupled to the strip by one or more hinges each having a first leaf recessed into the marginal portion of the panel, a second leaf adjacent to the second surface of the strip, and a bracket which is secured to the strip and supports the second leaf. A first section of the bracket overlies a portion of the front surface of the strip, and a second section of the bracket overlies a portion of the second surface of the strip. The second section has holes for fasteners which connect the bracket to the strip. The two mutually inclined sections of the bracket reduce the likelihood of separation of the hinge from the housing.

10 Claims, 6 Drawing Figures

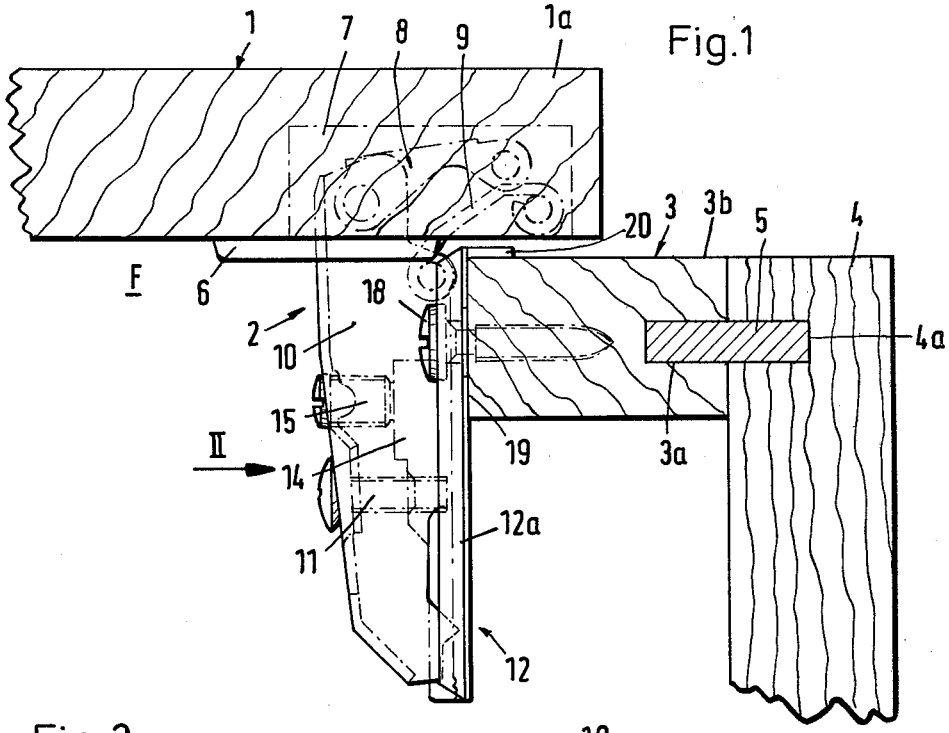
Fig.1
Fig.3
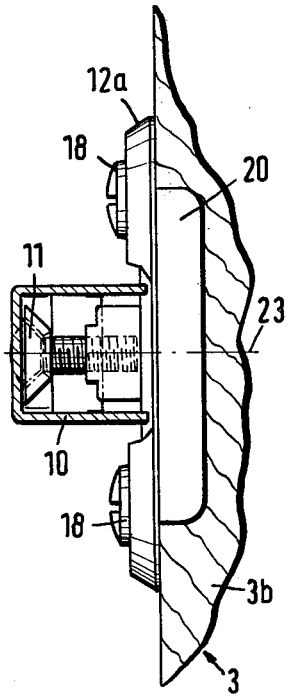
Fig.2
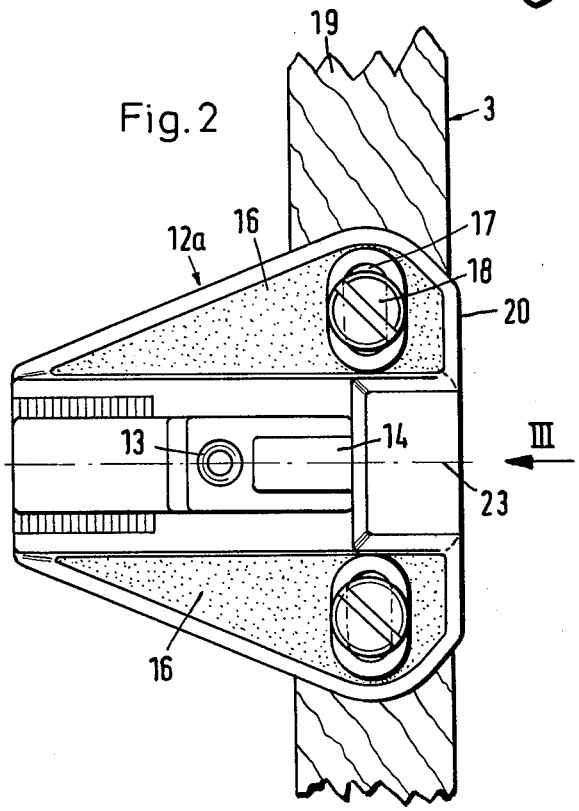

HINGE FOR THE DOORS OF CABINETS OR THE LIKE

BACKGROUND OF THE INVENTION

The present invention relates to chests, night tables and/or other types of cabinets, and more particularly to improvements in articulate connections between the housings and doors of pieces of furniture. Still more particularly, the invention relates to improvements in hinges which serve to articulately connect door panels or other movable parts to the housings of cabinets or other pieces of furniture in such a way that the movable parts are pivotable about substantially vertical axes.

It is already known to connect door panels to the housings of cabinets by means of hinges having first leaves which are recessed into the panels and second leaves which are articulately connected to the first leaves and are connected to the housing adjacent to the open front of the housing. A drawback of conventional hinges is that they cannot support very heavy movable parts and/or that they are likely to allow for detachment or undesirable reorientation of movable parts in response to the application of pronounced stresses which tend to detach the hinges from the housing and/or from the movable parts.

OBJECTS AND SUMMARY OF THE INVENTION

An object of the invention is to provide a novel and improved hinge for use in cabinets or other pieces of furniture to connect movable parts with stationary housings or the like.

Another object of the invention is to provide a hinge which can be connected to the housing and to the door panel of a cabinet in such a way that it can stand more pronounced stresses than heretofore known hinges.

A further object of the invention is to provide a cabinet or another piece of furniture wherein the door panel or panels are connected to the housing by one or more hinges of the above outlined character.

An additional object of the invention is to provide novel and improved means for connecting one leaf of a hinge to a stationary housing or other carrier for a pivotable member, such as the swingable panel of a door or the like.

One feature of the invention resides in the provision of a combination which is embodied in a piece of furniture having a housing with an open front and an upright wall portion (e.g., a strip made of wood) flanking one side of the open front and having several mutually inclined surfaces (including an outer or front surface and a second surface which bounds a portion of the open front), and a door panel or another movable part having an upright marginal portion which is adjacent to the wall portion. The panel is pivotally connected to the housing for movement about a vertical axis by at least one hinge which comprises a support (e.g., an L-shaped metallic bracket) secured to the wall portion and including several sections overlying different surfaces of the wall portion, a first leaf secured to the support, and a second leaf articulately connected to the first leaf and secured to the panel.

The outer surface and the second surface of the wall portion preferably make an angle of approximately or substantially 90 degrees, and the section which overlies a portion of the outer surface may have one or more prongs. The means for securing the first leaf to the support preferably includes several screws or other suitable fasteners extending through holes in that section of the support which overlies a portion of the second surface of the wall portion. The holes can extend through discrete wings of the just mentioned section.

The novel features which are considered as characteristic of the invention are set forth in particular in the appended claims. The improved hinge itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a horizontal sectional view of a portion of a cabinet and a plan view of a hinge which is constructed, assembled and mounted in accordance with one embodiment of the invention;

FIG. 2 is an elevational view of one leaf and of the bracket of the hinge as seen in the direction of arrow II in FIG. 1;

FIG. 3 is a view as seen in the direction of arrow III in FIG. 2, with the one leaf of the hinge shown in vertical section;

DESCRIPTION OF THE PREFERRED EMBODIMENTS

Figure 4:
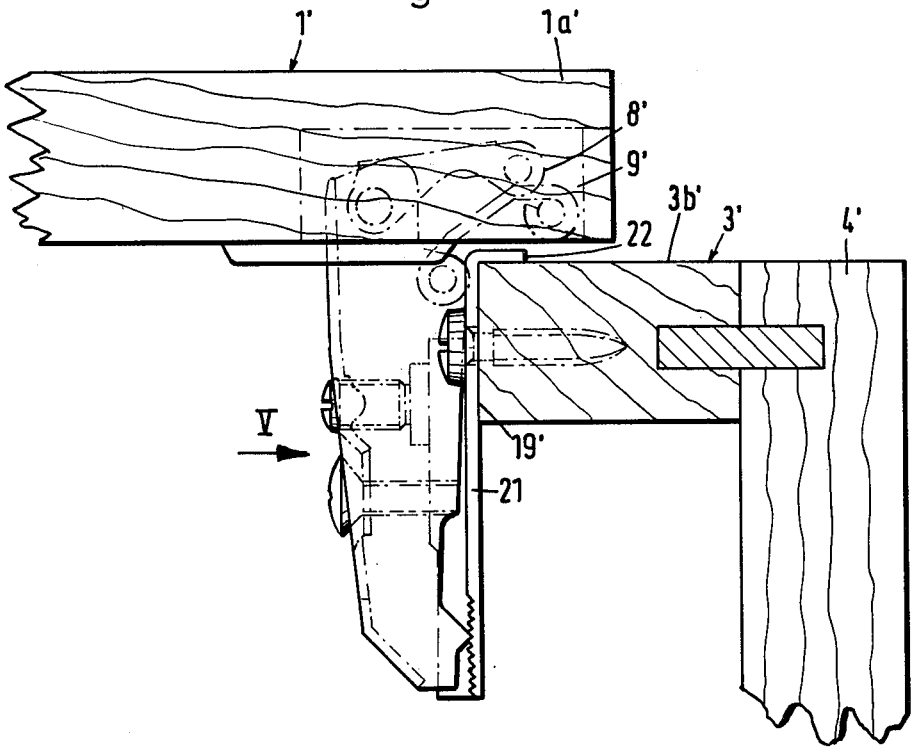
FIG. 4 is a horizontal sectional view of a portion of a cabinet and a plan view of a hinge which is constructed, assembled and mounted in accordance with a second embodiment of the invention.

Referring first to FIGS. 1 to 3, there is shown a portion of a piece of furniture in the form of a wooden cabinet which comprises a side wall 4 and a strip-shaped wall portion 3 connected with the side wall 4 by one or more tongues 5 extending into complementary grooves *3a*, *4a* of the components 3 and 4. The wall portion 3 (hereinafter called strip for short) is adjacent to one side of the open front F of the cabinet and has an exposed front surface *3b* as well as a second surface 19 which is immediately adjacent to and bounds a portion of the open front F. The surfaces *3b* and 19 make an angle of approximately or substantially 90 degrees. The cabinet further comprises a movable member or door having a panel 1 which has a marginal portion *1a* adjacent to the front surface *3b* of the strip 3 when the panel 1 is held in the closed position of FIG. 1 so that it conceals a portion of or the entire open front F of the cabinet (the extent to which the panel 1 conceals the open front F depends on the number of panels of which the movable member or door consists. The strip 3 is vertical and the marginal portion *1a* of the panel 1 is also vertical.

The structure of FIGS. 1 to 3 further comprises at least one hinge 2 which is constructed, assembled and mounted in accordance with a first embodiment of the invention. The hinge 2 defines a vertical pivot axis for the panel 1, i.e., the latter can be pivoted in a clockwise direction, as viewed in FIG. 1, toward the partly or fully open position and back to the closed position of FIG. 1.

The hinge 2 which is shown in FIGS. 1 to 3 comprises a first leaf 6 which resembles a casing and the major part of which is installed in a cutout 7 at the inner side of the panel 1. The manner in which the casing or leaf 6 is separably or permanently secured to the panel 1 is not specifically shown in the drawing; the connecting means may comprise screws, rivets and/or other suitable fasteners. A second leaf 10 of the hinge 2 is articulately connected with the leaf or casing 6 by means of links 8 and 9 so that it allows the panel 1 to pivot about the aforementioned vertical axis. The leaf 10 is secured to the strip 3 through the intermediary of a support 12 here shown as a bracket including two halves which are mirror symmetrical to each other with reference to a horizontal plane denoted by the phantom line 23. As shown in FIG. 2, the bracket 12 has upper and lower wings 16, and each of these wings has an elongated hole or slot 17 for a fastener 18 in the form of a screw which extends into the surface 19 of the strip 3. By partially unscrewing the fasteners 18, a person can readily adjust the level of the entire hinge 2. The means for securing the leaf 10 to the bracket 12 comprises at least one fastener in the form of a screw 11 or the like. The shank of the fastener 11 extends into a tapped bore 13 of the bracket 12. As shown in FIG. 1, the bracket 12 further comprises an anvil 14 for the tip of an adjusting screw 15 which meshes with and is rotatable relative to the leg 10. The screw 15 enables the person in charge to change the inclination of the leaf 10 with reference to the bracket 12. The bracket 12 preferably tapers toward the symmetry plans 23 and in a direction toward the interior of the cabinet including the side wall 4, strip 3 and panel 1. In other words, the width of the wings 16 decreases, as considered from the outer surface 3*b* of the strip 3 toward the interior of the cabinet.

In accordance with a feature of the invention, the bracket 12 comprises a first section 12*a* which carries the anvil 14 and is formed with the bore 13 and holes or slots 17, and a second section 20 which makes with the section 12*a* a right angle and overlies a portion of the front surface 3*b*. This contributes to stability of the hinge 2, i.e., the bracket 12 is much less likely to change its orientation with reference to the strip 3 and/or side wall 4, even in response to the application of appreciable tilting or other undesirable stresses upon the panel 1. The section 12*a* of the bracket 12 extends across a portion of the surface 19 and into the interior of the cabinet. FIG. 1 shows that the marginal portion 1*a* of the panel 1 conceals the entire section 20 when the panel 1 is held in the closed position.

When the panel 1 transmits a stress to the strip 3 via leaves 6, 10 and bracket 12, the bracket 12 bears against the surfaces 3*b* (section 20) and also against the surface 19 (section 12*a*) of the strip. If the strip 3 is a narrow portion of a composition or particle board panel, the material at its surface 3*b* can stand more pronounced stresses than the material which is adjacent to the surface 19. Thus, even though a relatively small effort must be exerted to drive the shanks of the screws 18 into the inner strata or core of the strip 3, the latter is capable of standing pronounced stresses which arise when the panel 1 tends to move in a direction other than about the aforementioned vertical axis which is defined by the links 8 and 9 between the leaves 6 and 10. Greater resistance to such stresses is attributable to the provision of the section 20 which overlies a portion of the front surface 3*b* of the strip 3. The section 20 contributes to more satisfactory anchoring of the bracket 12 and hence to more satisfactory retention of the entire hinge 2 in the selected position, even at the time when leaf 6 and/or 10 of the hinge 2 is subjected to substantial stresses which tend to separate the bracket 12 from the strip 3 and/or otherwise change the position or orientation of this bracket with reference to the parts 3 and 4 of the cabinet.

The term "cabinet" is intended to denote all pieces of furniture or the like wherein a housing has an open front and is provided with a door or a like movable portion which can be pivoted to and from a position in which the movable portion overlies or conceals a portion of the entire front side.

Figure 6:
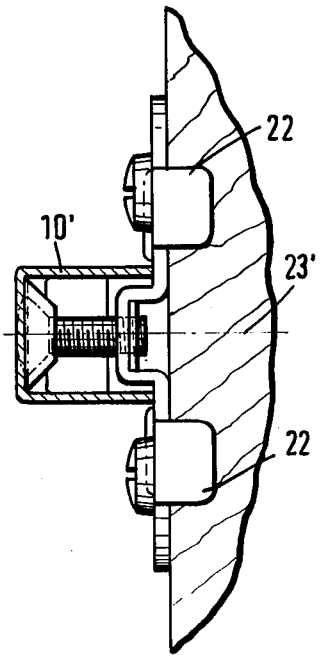
FIG. 6 is a view as seen in the direction of arrow VI in FIG. 3, with the one leaf of the modified hinge shown in vertical section.
Figure 5:
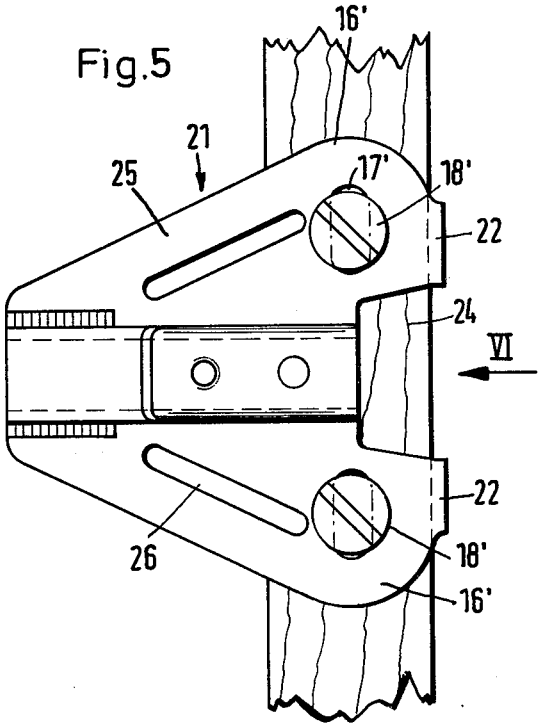
FIG. 5 is an elevational view of one leaf and of the bracket of the modified hinge as seen in the direction of arrow V in FIG. 4.

FIGS. 4, 5 and 6 illustrate a cabinet with a modified hinge 21. All such parts of the structure shown in FIGS. 4 to 6 which are identical with or clearly analogous to the corresponding parts of the hinge 12 are denoted by similar reference characters each followed by a prime.

The bracket or support of the hinge 21 comprises a first section 25 which is nearly identical with the section 12*a*, and a second section which includes two spaced-apart portions or prongs 22. These prongs are disposed at the opposite sides of the horizontal symmetry plane 23'. The wings 16' of the section 25 have reinforcing ribs 26. The two prongs 22 are respectively disposed above and below a recess 24 which extends into the section 25 and at least partly into the space between the two slots or holes 17'. The recess 24 receives at least a portion of at least one link, e.g., a portion of the link 8'. If the link or links of the hinge 21 are constructed or configurated in such a way that they do not extend beyond the exposed portion of the leaf 6 (see FIG. 1), the recess 24 can accommodate one or more portions of one or more different parts or components of the hinge 21. It will be noted that the section 12*a* of the hinge 2 shown in FIGS. 1–3 is also provided with a recess which resembles the recess 24.

The bracket 12 and/or 21 can be made of sheet metal or the like by stamping or by resorting to another suitable mass-manufacturing technique.

Without further analysis, the foregoing will so fully reveal the gist of the present invention that others can by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A piece of furniture comprising a housing having an open front and an upright wall portion flanking one side of said open front and having several mutually inclined substantially planar surfaces; a movable member having an upright marginal portion adjacent to said wall portion; and at least one hinge pivotally connecting said member to said wall portion so as to permit movements of said member about a substantially vertical axis, said hinge including a support secured to said housing and including several sections each overlying a different planar surface of said wall portion and one of said sections containing a recess also overlying one of said planar surfaces and contiguous to another of said several sections, a first leaf secured to said support, and a second leaf articulately connected to said first leaf and secured to said member.

2. The structure of claim 1, wherein said surfaces include an outer surface and a second surface surrounding a portion of said open front, said outer surface and said second surface making an angle of substantially 90 degrees.

3. The structure of claim 2, further comprising fastener means securing one of said sections to said second surface of said wall portion.

4. The structure of claim 3, wherein said one section has several wings with holes for said fastener means.

5. The structure of claim 2, wherein said sections include a first section overlying said outer surface and a second section secured to said second surface, said first section having a plurality of prongs.

6. The structure of claim 5, wherein said prongs include first and second prongs which are mirror symmetrical to each other with reference to a substantially horizontal plane halving said second section.

7. The structure of claim 6, wherein said recess is disposed intermediate said prongs and said second section has holes disposed above and below said recess, and further comprising fastener means extending through said holes to secure said second section to said wall portion.

8. The structure of claim 1, wherein said surfaces include an outer surface and a second surface immediately adjacent to and bounding a portion of said open front, said sections of said support including a first section overlying said outer surface and a second section overlying said second surface, said second section tapering in a direction toward the interior of said housing.

9. The structure of claim 1, wherein said support is a bracket one section of which extends in part into the interior of said housing.

10. The structure of claim 1, further comprising means for adjusting said first leaf with reference to said support.

* * * * *

UNITED STATES PATENT AND TRADEMARK OFFICE

CERTIFICATE OF CORRECTION

PATENT NO. : 4,312,098

DATED : January 26, 1982

INVENTOR(S) : Günter SUNDERMEIER

It is certified that error appears in the above-identified patent and that said Letters Patent are hereby corrected as shown below:

Item [75], "Bundle" should read --Bünde--.

Signed and Sealed this

*Fourteenth* Day of *September 1982*

[SEAL]

*Attest:*

GERALD J. MOSSINGHOFF

*Attesting Officer* *Commissioner of Patents and Trademarks*